United States Patent [19]

Scheld

[11] Patent Number: 5,059,334

[45] Date of Patent: Oct. 22, 1991

[54] LUBRICANT

[75] Inventor: John L. Scheld, West Orange, N.J.

[73] Assignee: Tribophysics Corporation, Wayne, N.J.

[21] Appl. No.: 903,483

[22] Filed: Sep. 4, 1986

Related U.S. Application Data

[63] Continuation of Ser. No. 716,933, Mar. 28, 1985, which is a continuation of Ser. No. 220,654, Dec. 29, 1980.

[51] Int. Cl.[5] ..... C10M 111/04

[52] U.S. Cl. ..... 252/32.5; 252/58

[58] Field of Search ..... 252/58, 325

[56] References Cited

U.S. PATENT DOCUMENTS

| | | | |
|---|---|---|---|
| 3,247,116 | 4/1966 | Reiling | 252/58 |
| 4,096,079 | 6/1978 | Pardee | 252/58 |
| 4,224,173 | 9/1980 | Reick | 252/52 A |

*Primary Examiner*—Jacqueline V. Howard

*Attorney, Agent, or Firm*—James Creighton Wray

[57] ABSTRACT

A liquid having solid fluorocarbon particles, a buoyant medium, a carrier medium, and a vehicle diluent is disclosed. Said lubricant may be sprayed on a surface whereupon the diluent will vaporize having a coating which may include fluorocarbon particles, 50–70 weight mineral oil and tricresyl phosphate.

19 Claims, No Drawings

LUBRICANT

This application is a continuation of application Ser. No. 716,933, filed Mar. 28, 1985, which is a continuation in part of appln. Ser. No. 220,654, filed Dec. 29, 1980.

BACKGROUND OF THE INVENTION

This is a continuation-in-part of U.S. patent application Ser. No. 220,654, filed Dec. 29, 1980.

This invention relates generally to lubricants and more particularly has reference to lubricants containing a dispersion of solid lubricant particles, a vapor degreasing agent and a corrosion inhibitor and a carrier, vehicle or solvent.

Pertinent United States and foreign patents are found in Class 252, subclasses 60 and 58 and in Class 585, subclass 12 of the Official Classification of Patents in the United States Patent and Trademark Office.

Examples of pertinent patents are U.S. Pat. Nos:

| | | |
|---|---|---|
| 2,510,112 | 3,159,557 | 3,194,762 |
| 3,314,889 | 3,432,431 | 3,493,513 |
| 3,505,229 | 3,536,624 | 3,640,859 |
| 3,723,317 | 3,933,656 | 4,029,870 |
| 4,127,491 | 4,224,173 | |

U.S. Pat. No. 4,224,173 describes an eight step method for making lubricant oil containing polytetrafluoroethylene particles and a fluorochemical surfactant.

U.S. Pat. No. 2,510,112 describes an aqueous dispersion of colloidal polymerized polytetrafluoroethylene in a fluorinated hydrocarbon oil.

U.S. Pat. No. 3,194,762 describes a product having resin particles suspended in an oil base.

U.S. Pat. Nos. 3,159,557; 3,432,431; 3,493,513; 3,505,229; 3,630,901 and 3,640,859 describe greases containing polytetrafluoroethylene particles.

U.S. Pat. No. 3,723,317 describes a grease wherein triazene is combined with polytetrafluoroethylene to thicken a fluorinated polyether base oil.

U.S. Pat. No. 4,029,870 describes unsintered polytetrafluoroethylene which has been irradiated.

U.S. Pat. No. 3,933,656 describes sub-micron polytetrafluoroethylene particles.

U.S. Pat. No. 4,127,491 describes an aqueous dispersion of polytetrafluoroethylene particles.

The benefits of solid particle lubricant additives have been recognized for some time. Tests indicate varying but consistent improvements in engine efficiency through the use of molybdenum disulfide and graphite. The effects of solid particles as a cushion between sliding metal parts having been established, the natural tendency is to develop improved or advanced products. Polytetrafluoroethylene has been introduced as a solid particle additive that exhibits the same cushioning effects as molybdenum disulfide and graphite, but with the advantage of being a cleaner material to work with and a better or lower friction lubricant.

However, there are several problems associated with the use of polytetrafluoroethylene particle additives.

The preparation of a stable dispersion through chemical stabilization of polytetrafluorethylene is a complex and exacting science. One such stabilization technique is described in U.S. Pat. No. 4,127,491.

Moreover, the dispersion achieved by the chemical stabilization method is short-lived. Upon standing for short periods of time, the particles settle and develop what could be called a "hard settle", i.e., the particles cannot be redispersed.

Added to the "hard settling" problem are the in-service problems of short-lived effectiveness. The apparent problem with dispersions achieved by the chemical stabilization method is that the surface active materials and film forming polymers become ineffective after a brief period of use.

Conventional liquid lubricants are, for the most part, single purpose. That is they usually are directed to performing a single task such as reducing friction of contacting parts by covering the parts with a thin film. It is well known that conventional lubricants contain additives for one or more special purposes in addition to the basic objective of lubrication. Such additives may: deter environmentally created surface degredation such as oxidation and corrosion; extend the life of surfaces which are constantly exposed to ultraviolet radiation; deter build-up in/or facilitate easy removal of debris (e.g., dust, dirt, salt, marine growth); prevent or reduce moisture penetration of protective materials which can lead to corrosion and failure of the protected object or assembly; and more rarely, reduce fluid friction drag. Usually the lubricant additive is targeted towards protecting that which is being lubricated from one or two different situations. The present invention provides a specialized lubicant in addition to a broad scope protective additive.

SUMMARY OF THE INVENTION

The present invention overcomes many of the problems which exists in the prior art.

In the present invention, sintered and ground solid lubricant particles, preferably, polyfluoronated alkoxy (PFA), fluorinated eythelene propolene (FEP) or polytetrafluoroethylene (PTFE) are physically disbursed in a tricresyl phosphate carrier medium. This formulation has a rather high viscosity so it is diluted with a chlorinated solvent as a vehicle. It is preferred the vehicle or solvent be 1,1,1-trichloroethane The particles are wetted with aliphatic naphtha, are precoated with an olefin copolymer and are coated with 10-70 weight oil having a low miscibility in tricresyl phosphate and a lower specific gravity than tricresyl phosphate. The diameter of the particles is in the range of about 0.5 microns to about 20 microns. Depending upon the viscosity desired, the mixture is then diluted with a chlorinated solvent vehicle, preferably 1,1,1 trichloroethane. Dow Chemical Corporation manufactures a product called CHLOROTHENE VG which suffices for the vehicle.

The lubricant of the present invention is formed by mixing the wetted, precoated polytetrafluoroethylene particles with the 50 weight oil at high speed under heat of about 130 degrees and/or pressure 25 inches mercury. Mixing continues about 30 minutes. The tricresyl phosphate is then added and the resultant mixture is sheered at high speed under vacuum about 15 minutes. This mixture is useful as an oil additive or as a spray on coating. It is preferred that the vehicle or diluent be combined with the above mixture at a ratio of about 1—1 for a high viscosity liquid surface lubricant and at a ratio of about 1 part mixture and 20 parts vehicle or diluent for a low viscosity liquid surface lubricant. Aliphatic naphtha is preferred as a vehicle for penetration of the composition into machinery.

An interesting feature has been discovered concerning the combination of the diluent with the mixture of lubricant particles, oil and tricresyl phosphate.

Fluorocarbon has been used extensively as a dry, bonded particulate lubricant. Among such lubricants, which include molybdenum disulfide, silicone, and graphite, the fluorocarbon is the only particulate that reduces the coefficient of friction with pressure. Moreover, the fluorocarbon has a substantial thermal envelope ranging from about −150 degrees F to over +600 degrees F.

The chemical resistance of fluorocarbon is unmatched by other particulates. This includes resistance to acids, alcohols, aldehydes, hydrocarbons, ketones, and oxidizing agents.

Fluorocarbon also demonstrates extremely low thermal conductivity in comparison with the considered particulates.

Treated surfaces become essentially hydrophopic and resistant to foreign debris attachment. In addition to providing significant corrosion and oxidation prevention, substantial drag and/or friction reduction is effected.

In the liquid materials, the fluorocarbon particles are blended with phosphate esters in a pure mineral oil. The phosphate esters are the materials's primary dispersant. The dispersant qualities of the phosphate ester are well-defined. It is believed the phosphate ester seeks out wear sites and hot spots. Because of the total synergism of the phosphate ester and the fluorocarbon, the seeking phosphate ester carries the fluorocarbon and codeposits the particles. The phosphate ester attaches and the fluorocarbon remains on the surface and comes into action. With the attachment and surface smearing of the fluorocarbon particle, a long lasting effective solid particle lubrication results.

The net negative electrostatic nature of the material repells foreign debris and surface foulants, corrosion and oxidation agents, and reduces drag and/or friction.

Coupled with the well-defined hydrophobic qualities of the fluorocarbon and phosphate esters, the surface coating results in the prevention of water induced corrosion.

The liquid materials are brushable and sprayable.

The essential synergism of the fluorocarbon and phosphate ester evidenced in the liquid material is also present in the viscous materials.

The 1:1 type viscous format allows a higher concentration of oil components on the surface. This material is also brushable and sprayable.

All the materials have been tested in accordance with applicable Society of Automotive Engineers, American Society for Test Materials, Federal Test Methods, and Military Specification standards. Physical and Chemical Product Specifications are available for all materials.

Extensive performance testing has been conducted in gasoline and diesel fueled engines, aircraft reciprocating engines, Falex and Timken pressure devices, and in a number of weapons ranging from handheld through heavy artillery pieces.

One object of the invention is, therefore, to provide an improved lubricant.

Another object of the invention is to provide a lubricant containing a dispersion of solid lubricant particles.

Yet another object of the invention is to provide an oil additive containing a dispersion of polytetrafluoroethylene particles.

Still another objective of the invention is to provide an improved spray-on coating.

Another objective of the invention is to provide a lubricant comprising solid lubricant particles in a carrier medium, said particles being coated with a buoyant medium having lower specific gravity than the carrier medium.

Yet another object of the invention is to provide a composition of matter comprising polytetrafluoroethylene particles in a tricresyl phosphate carrier medium.

Still another object of the invention is to provide a method for reducing the apparent specific gravity of particles comprising coating the particles with a material having a relatively low specific gravity.

A further object of the invention is to provide a lubricating oil additive comprising solid lubricant particles in combination with tricresyl phosphate carrier medium.

Another object of the invention is to provide a method of dispersing solid particles in lubricating oil comprising dispersing said particles in a tricresyl phosphate carrier medium to form an oil additive, and combining said additive with said oil.

Another object of the invention is to provide a method of wetting polytetrafluoroethylene material comprising coating said material with aliphatic naphtha.

Another object of the invention is to provide wetted polytetrafluoroethylene material comprising polytetrafluoroethylene material coated with aliphatic naphtha.

Still another object of the invention is to provide a method of making a stable dispersion comprising combining particles with a buoyant medium to form a first combination, subjecting the first combination to an atmosphere drawn to substantially vacuum, mixing the first combination at high speed in said atmosphere, combining the mixed first combination with the carrier medium to form a second combination, subjecting the second combination to an atmosphere drawn to substantially vacuum, and shearing the second combination at high speed in said atmosphere.

Yet another object of this invention is to provide a relatively low viscosity fluid which functions as a surface penetrating lubricant for metal surfaces, thereby minimizing friction drag, surface fouling, debris attachment, water adhesion and corrosion.

Still another object of this invention is to provide a lubricant for fire arms, circular saw blades, lawn mowers, pulse-type humidifiers, home furnaces, sail cloth, chain saws, electrical connections, automobile headlights, computer disc drives, computer dot matrix printers, spring wound clocks, rusty equipment, metal drilling, metal tap and die, threaded fasteners and virtually any sort of surface requiring lubricant and anti-corrosion protection.

DESCRIPTION OF THE PREFERRED EMBODIMENT

The lubricant of the present invention has ground and sintered polytetrafluoroethylene, (PTFE), particles physically dispersed in a carrier medium. The mixture is then diluted with a chlorinated solvent vehicle such as for example, 1,1,1-trichloroethane.

The theory of creating the suspension in the present invention is relatively straightforward. Heavy particles, such as PTFE particles, are coated with a relatively low specific gravity buoyant medium, thus lowering the apparent specific gravity of the particles. The coated particles are then floated in a relatively high specific gravity carrier medium. the resulting dispersion with stand for months and will not become solid or difficult to redisperse.

Ground PTFE particles are used because of their durability and because of their inertness and low coefficient of friction.

PTFE has long been used as a dry, bonded particulate lubricant/coating. Among such type materials, which include molybdenum disulfide, silicone, and graphite, fluorocarbons are the only particular that reduce coefficient of friction as pressure increases. Moreover, PTFE has a substantial thermal range from −150 degrees F. to over −600 degrees F. The chemical resistance of PTFE is unmatched by other particulates. These properties include resistance to acids, alcohols, aldehydes, hydrocarbons, ketones and oxidizing agents. PTFE treated surfaces become essentially hydrophobic and resistant to foreign debris attachment. A substrate penetration by PTFE material into treated surfaces provides significant corosion and oxidation prevention and, additionally, substantial fluid friction and/or drag reduction.

The use of sintered polytetrafluoroethylene particles reduces the possibility of low boiling polytetrafluoroethylene particles being introduced to the combustion process of an engine. Sintered particles also have smoother surfaces and a more uniform geometry than the non-sintered particles used in the prior art.

The polytetrafluoroethylene particles used in the present invention are generally larger than the particles used in the prior art. The maximum particle size is determined by the intended use of the lubricant. For engine use, the particles must be small enough to pass through the engine's oil filter. Prefereably, the particles have a diameter of below 7 microns for about 90% of the particles. Particles at the upper ends of the useful ranges are more difficult to keep dispersed.

Polytetrafluoroethylene particles manufactured by LNP Corporation of PLhiladelphia, Pa., under the designation TL 102 are particularly suited to the present invention.

Preferably, the particles make up about 0.02 percent to about 2 percent of the volume of the lubricant.

Efforts to calculate the buoyant effect of the low specific gravity medium on the basis of surface area versus particle mass prove to be no more accurate than the empirically derived method of adding more low specific gravity medium than is necessary and allowing it to rise to the top of the dispersion when it is mixed with the high specific gravity medium. It is important to use a low specific gravity medium that has low miscibility in the high specific gravity medium, and to start by adding to the miscibility point.

Tricresyl phosphate is particularly useful as the high specific gravity medium of the present invention. Tricresyl phosphate has been used for many years as a high pressure lubricant additive in greases, oils and gasoline. In addition to its lubricant properties, tricresyl phosphate tends to attach to scarred places in a cylinder wall, for example, and prevents further abrasion in that area. This is an extremely beneficial phenomenon and tests by NASA have shown oil life extended to 20,000 miles through the use of tricresyl phosphate additives.

Shell Oil Company's aviation grade 10 to 70 w. oil is the preferred low specific gravity medium used in the present invention. That oil was selected primarily because of its low specific gravity and high quality.

Agglomeration can be further prevented in the present invention by pre-wetting the polytetrafluoroethylene particles. Preferably, particles are pre-wet with aliphatic naphtha. Aliphatic naphtha is particularly useful because it wets out instantly, prohibits any agglomeration, breaks up any agglomeration that may already be present, and does not break down in oil.

Alternatively, the polytetrafluoroethylene particles can be prewet with an other compatible solvent. Preferably, the wetted particles are precoated with an olefin copolymer such as Texaco TLA 510. The wetted precoated particles are mixed into the mineral oil. Then the mineral oil coated, precoated and prewetted particles are mixed with TCP. The TCP mixture, known as the oil components, are mixed with a vehicle. The Dow Chemical Company sells a product which is adequate for this purpose deemed CHLOROTHENE VG. This is a proprietary product containing about 95% 1,1,1-trichlorethane and 5–6% corrosion inhibitor. This solvent is what is deemed a vapor degreaser and is highly effective for cold cleaning, whether the method be dip, spray, wipe, flush or ultrasonic and whether the job be parts cleaning or maintenance operations. The tricholorethane is not as unhealthy and does not cause the fire hazards which are normally associated with the use of petroleum solvent blends, e.g., alcohols, ketones, xylenes, benzines and toluene materials. The CHLOROTHENE VG solvent has no fire or flash point as determined by standard test methods.

A method for making the lubricant of the present invention can now be described.

The polytetrafluoroethylene particles are ground and sintered. The resulting powder is then pre-wet and precoated.

The low specific gravity oil is then added to the wetted and precoated powder. That mixture is then placed under reduced pressure of about 25–27 inches at standard barometric pressure of 29.92 inches. While the vacuum is being drawn, the mixture is blended at high speed. Preferably, the high speed mixing is at least 4,000 rpm. with an 8 inch disc. The mixing can be conveniently carried out in a standard Manton Gaulin cone type homogenizer.

50 gallon quantities of the mixture will usually require 30 minutes of mixing and vacuum.

Tricresyl phosphate is then added and the resultant mixture is sheared and vacuumed for 15 minutes.

A high viscosity fluorocarbon lubricant valuable in and of itself as an oil additive is established at this point.

To transform the high viscosity fluorocarbon lubricant into a more flexible application format, CHLOROTHENE VG is mixed with the fluorocarbon lubricant.

The viscosity of the invention may be adjusted by varying the ratio of the vehicle to the high viscosity fluorocarbon lubricant. The preferred ratios are 1 part vapor degreaser to 1 part liquid lubricant to a maximum of about 20 parts vehicle to 1 part liquid lubricant.

One of the most significant problems associated with liquid fluorocarbon lubricants is a short shelf life resulting from the phenomenon of irreversible coaggulation. That is, permanent separation of the fluorocarbon particles from the constituent mixture can occur. Various mixture ratios ranging from one part vapor degreaser per one part lubricant to 16 parts vapor degreaser per one part lubricant have been monitored. In no case, even after the samples were undisturbed for 6 or more months was irreversible coaggulation encountered. Although sedimentation occurred, homogeneity of the mixture was restored through vigorous agitation for approximately 30 to 60 seconds.

A sample formula is as follows:
polytetrafluoroethylene, 3 grams
aliphatic naphtha, 3 grams
Shell aviation grade aviation 50 weight oil, 1.8 fluid oz.
tricresyl phosphate, 2.0 fluid oz.
Chlorothene VG, 4 fluid oz.

The general purpose of the invention is as a light to medium duty anti-corrosion lubricant. It is preferred that an absolute minimum of 60 degrees F. must be maintained throughout the application process. Ideally, an ambient temperature range of 90 to 100 degrees F. for both product and the object or assembly being coated is preferred so that maximum adsorption and penetration of the product can be maximized.

Cleanliness of the surface to which the product is applied is essential. The surfaces are wiped on with clean cloth saturated with pure CHLOROTHENE VG. If the size of the object or assembly permits, and is particularly greasy, dipping or pressure washing with chlorothene VG is recommended to obtain maximum cleanliness. However, it should be noted, if the object or assembly is plastic or contains plastic parts, the solvent may not be compatible. The following table presents compatibility data concerning the vapor degreaser.

COMPATABILITY DATA:
EFFECT OF SPRAYING CHLOROTHENE VG SOLVENT ON VARIOUS MATERIALS

| Material | Effect |
|---|---|
| oil cloth | None |
| Formica plastic | None |
| vinyl plastic | None |
| Congoleum linoleum | None |
| vinyl floor tile | None |
| asbestos asphalt file | Surface softened, color comes off on cloth if rubbed |
| vinyl asphalt floor tile | Same as above |
| rubber floor tile | Same as above |
| terrazzo floor tile | None |
| ceramic wall tile | None |
| porcelain | None |
| wall tile made of Styron polystyrene | Badly frosted, surface actually dissolved |
| varnish | No visible surface effect, slight color left on cloth if rubbed |
| Duco enamel | None |
| latex wall paint | No visible surface effect, slight color left on cloth if rubbed |
| flat oil paint | None |
| latex foam rubber | Swells foam, weakens cell structure |
| acetate rayon | None |
| viscose rayon | None |
| Dacron polyester | None |
| Orlon acrylic | None |
| silk | None |
| nylon | None |
| Saran film | None |
| Plexiglas acrylic | None |
| polyurethane foam (rigid) | Extremely slight swell with no apparent after effect |
| polyurethane foam (flexible) | Swells. Returns to original shape with no permanent observable effect |
| Mylar film | None |
| polyvinyl alcohol | None |
| polyvinyl chloride | None |
| Teflon tetrafluoroethylene | None |
| neoprene rubber | Swells on prolonged contact |

To apply the invention with a pressure spray, an air compressor capable of producing a sustained minimum of 60 pounds per square inch is required. Preferably, an air pressure filter/regulator with water trap which is compatible with the compressor is required. Any quality spray gun with a nozzle designed for spraying thin-based coatings, e.g., lacquer, low viscosity oils, etc., will suffice.

If the invention is to be applied by painting, any common nylon bristle brush or paint roller may be used.

If the invention is to be applied by dipping, a polyethylene or metal container appropriately sized may be used.

Generally, the surfaces to be coated are cleaned and the product is sprayed on in full strength. Preferably within 30 minutes the invention should be agitated during the application. It is preferred that the application be in thin successive coatings until the buildup of lubricant is satisfactory to the user. Judgment is required by the user in general purpose applications. Time should lapse between applications to permit evaporation of the vapor degreaser. It should be kept in mind that the evaporation is temperature and quantity dependent. The higher the temperature and the thinner the coating, the more rapid the evaporation of the degreaser. It is estimated that time intervals between coatings may range from a few seconds to five minutes on the average. For maximum corrosion protection and lubrication effectiveness, the product should be worked into the surfaces through the application of heat or pressure or optimally, both at the same time. Reapplication after initial treatment is, of course, dependent on the severity of the lubrication/protection environment. In any event, the user can anticipate a minimum of 50% increase in lubricant and corrosion protection life over conventional petroleum base or dry bonded lubricants. Until more data is obtained, reapplication of the product is recommended annually as a minimum, or as required dependent on the particular usage. This one year period is based on the constraints composed by the time period during which the product was undergoing evaluation in real world tests.

To use the invention as a drag reduction, anti-debris attachment, anti-foulant lubricant, one should use the following procedures. The surface to which the invention will be applied should be cleaned as described above. If there are relatively large surfaces to be coated, e.g., ship hulls, pressure spray equipment is preferred. Preferably, the compressor and regulator are set to produce 60 pounds per square inch of pressure at the spray gun/air hose junction. Average coverage per single coat of spray is 350 square feet per gallon. Although the spray is non-toxic, use of a respirator by the spray gun operator is highly recommended. The spray gun fluid control valve may be adjusted as required to produce a thin coating on the application surface. The spray gun operator's stroke should be rhythmic over a range of 12 to 14 inches per second releasing the spray gun trigger at the end of each stroke to prevent excessive product buildup in the spray overlap areas. The coating is allowed to "set up", e.g., allow evaporation of the vapor degreaser carrier, for 5 to 10 minutes. To "work" the product into the surface, it is preferred a mechanical buffer, e.g., electric or air driven, applying moderate pressure be used. As a guide, on a horizontal surface, the weight of the buffer apparatus alone will provide adequate pressure. As a surface will usually have a slight tackiness after spraying, buffing should be continued until the tackiness is eliminated. It has been noted after many applications to various surfaces, that the higher the ambient temperature, the less the tackiness before buffing. Any subsequent coating added should also be worked in the same manner.

The spray coating is transparent and has not effected any noticable color change in painted or bare surfaces. If for any reason the invention is to be removed as might be the case in repainting a surface, wet sanding with wet or dry 600 grit silicon carbide sandpaper is all that is required. This is not an unusual requirement, but rather a standard method of preparing any surface for painting or repainting. The following is a table indicating the various usages for the invention.

Although the lubricant was originally formulated as an internal combustion engine oil additive, the Tribophysics Corporation, i.e., the manufacturer, has conducted many new tests of the invention in a variety of applications. The invention was tested primarily as a general purpose lubricant but with emphasis on military and law enforcement requirements. As a result, intense investigation of product performance in the ballistics area was undertaken.

Summary of Ballistic Tests

Test weapons a) Smith & Wesson, 38 Custom, 6" barrel
b) Smith & Wesson, 0.357 Model 19 Magnum, 4" barrel
c) Remington, Model 700, 0.223 Caliber
d) Ruger, Model 77, 0.270 Caliber
e) Sako Carbine, 7.62 mm
f) Remington Model 308, 0.30-06
g) Winchester, Model 12, Modified 12 guage shotgun
h) Remington, Model 870 shotgun
i) Viking, Machine-gun 9 mm
j) K-Gun (Assault Weapon), 0.223 Caliber
k) Special Assault Shotgun, 12 guage Parameters evaluated a) Velocities/Range
b) Accuracies
c) Rates of Fire
d) Component wear
e) Component fouling
f) Projectile penetration
g) Corrosion

| APPLICATIONS LISTING | |
|---|---|
| Circular saw blades | Debris buildup |
| Lawnmowers | Debris buildup |
| Pulse-type Humidifiers | Anti-corrosion and easy |
| Home furnaces | removal of debris |
| Sailcloth | Water adsorption |
| | Salt attachment |
| | Ultraviolet deterioration |
| Chainsaws | Lubrication & debris buildup |
| Electrical Connections | Anti-corrision |
| Automobile headlights | Bug attachment |
| Computer disk drives | Lubrication |
| Computer Dot-Matrix Printers | Lubrication |
| Spring-wound clocks | Lubrication and accuracy |
| Rusty equipment | Prevent rust migration |
| Metal drilling | Lubrication and efficiency |
| Metal Tap and Die | Lubrication and efficiency |
| Threaded Fasteners (screws, nuts, bolts) | Anti-corrosion and ease of assembly |

The invention has been tested extensively with firearms. Comparisons were made between treated firearms and untreated firearms.

Muzzle velocity was measured by chronograph equipment on several weapons in "before-and-after-treatment" evaluation. In all cases, 10 rounds were fired through untreated weapons to provide control data. Each series cartridge was carefully loaded and reloaded to minimize errors that could result from variations in the amount in composition of commercially produced cartridge propellents. Usually, increased velocities were recorded after 20 to 30 rounds of ammunition were fired.

| MUZZLE VELOCITIES | Untreated | Treated |
|---|---|---|
| Remington 700 | 3122 fps | 3163 fps |
| Sako Carbine | 3146 fps | 3173 fps |
| Ruger 77 | 2724 fps | 2788 fps |
| Remington 308 | 2729 fps | 2787 fps |
| S & W .357 Magnum | 721 fps | 728 fps |

Accuracy data was assessed on treated weapons as compared to untreated weapons. Impact areas were measured. For the shoulder fired weapons, the range was 100 yards and for the hand guns the range was 50 yards. The following is the data collected.

| | Untreated | Treated |
|---|---|---|
| Remington 700 | 8.06 $cm^2$ | 7.82 $cm^2$ |
| Sako Carbine | 10.88 $cm^2$ | 9.90 $cm^2$ |
| Remington 308 | 37.67 $cm^2$ | 13.63 $cm^2$ |
| S & W 38 Special | | |
| 6 round series | 25.99 $cm^2$ | 21.31 $cm^2$ |
| 24 round series | 69.12 $cm^2$ | 46.54 $cm^2$ |

Firing rates were measured for three fully automatic weapons: the K-Gun, a 5.56 millimeter sub-machine gun; a modified Remington Model 12 shotgun; and the Viking, a 9 millimeter sub-machine gun. The data is as follows:

| RATES OF FIRE SUMMARY | Untreated | Treated |
|---|---|---|
| K-Gun | 800 rpm | 1000 rpm |
| Model 12 | 40 rpm | 50–60 rpm |
| Viking | 750 rpm | 950 rpm |

The La France Firearms Corporation, developer of the K-Gun, fired 15,000 rounds through a weapon treated with the invention. Untreated weapons were found to jam 3 or 4 times during each 100 rounds of firing. No jaming or fouling was recorded throughout the 15,000 round test with the treated weapon. Moreover, the La France Firearms Corporation K-Gun specification now guarantees an interval of 2,500 rounds between cleanings and a system life of 25,000 rounds when treated with the invention.

The agency armorer of the Maryland State Police conducted tests of an untreated, then treated custom, PPC revolver utilizing a Ransom machine rest. Winchester-Western 148 grain 38 special mid-range match wad cutter rounds were used. A total of 48 control data rounds were fired from the untreated weapon. Normally, when the subject round is used, a severe leading build up is experienced, especially in the forcing cone area. The revolver was then treated with the invention. After 144 rounds were fired through the treated weapon, no leading or fouling occured. The test was continued to completion with a total of 2,500 rounds being fired. Observed leading was minimal and the very small amount of bore fouling was easily removed with a cleaning patch. Also, all external fouling was easily wiped off. This is normally a rather tedious process.

The firearms training division of the District of Columbia Metropolitian Police Department conducted foulant testing using two Remington model 870 shotguns. One shot gun was treated with MIL-L-63460 and the other with the invention. A total of 1,230 rounds were fired through the one lubricant treated weapon and 1,440 rounds were fired through the invention treated shot gun. The following are excerpts from the test report:

(a) "Examining inside the receiver around the ejection port, the fluorocarbon treated weapon was at least 60% cleaner than the other weapon."

(b) "Removing the barrels from both weapons revealed much less fouling in the chamber area and bore of the fluorocarbon treated weapon."

(c) "A dry brush was passed through each barrel about four times. This removed most of the fouling from the fluorocarbon lubbed barrel, but not from the other barrel. Solvent was then used to clean both barrels. The barrels lubbed with fluorocarbon cleaned much more quickly, especially in the chamber area where powder and plastic fouling was most severe."

The United States Naval Academy, Annapolis, Md. regularly uses 12 Colt 45 automatic hand guns to carry out small arms weapon training for each current freshman class. The life of each hand gun is 8,000 to 10,000 rounds. Approximately 5,000 rounds are fired through each hand gun every plebe summer. After the 1983 summer training was completed, results were that there were no jams or misfires in any of the guns for over 60,000 rounds expended. The 12 weapons were routinely treated with the invention.

The Light Attack Wing Pacific Fleet, United States Navy, evaluated the invention performance on multiple ejector and triple ejector aircraft weapon delivery racks for 6 months. The invention was applied to rack breaches, gun and piston assemblies. Results of the evaluation showed that burnt powder and foulant residue is easy to remove. In addition, the spent rack cartridges were much easier to remove from the breaches.

Because of the recorded velocity increases, of friction losses, in energy improvements resulting from other evaluations, a projectile penetration test was conducted by firing one inch length studs into a two inch thick concrete slab. The stud gun used was 22 caliber. Twenty five untreated studs and 25 invention treated studs were fired. Depth measurements showed that the treated studs penetrated at least ⅛ inch deeper into the slab. The slab was then broken apart in order to observe the physical condition of the studs. In all cases, the untreated studs were caked with dust and artifacts. In no case was this "snow capping" phenonemon detected on the invention treated studs.

Considerable corrosion testing of the fluorocarbon product has been conducted. This has included dissimilar metal combinations, e.g., aluminums, stainless steel, copper, carbon steels, cold rolled steel, and aircraft wing sections. Treated surfaces have consistently demonstrated remarkable and repeatable corrosion control and lubrication properties. While the precise physical processes leading to these results are not fully understood, the protection process appears to be electrochemical in nature. A possible hypothesis suggests that the fluorocarbon product is not only preventing oxygen from attacking treated surfaces but is actually capable of displacing water or its constituents such as oxygen or free radicals from the molecular structure of the treated surface. Nonetheless, in terms of real world observations, a sailing yacht charter organization based in Annapolis, Md. has been using the invention in topside stainless fittings and equipment in their charger fleet for forty boats for nearly two years in the Caribbean. Dramatic reductions in corrosion and electrolytic processes have been observed. Similar results were obtained during nine months of treatment of topside marine equipment on the 12-Meter yachts, DEFENDER and COURAGEOUS, during the 1983 America's Cup preparation and trials.

Two Smith & Wesson 38 Special revolvers were used to observe the effects of salt water immersion. One weapon was thoroughly treated with the fluorocarbon lubricant; the other was treated with conventional lubricants. Both weapons were suspended in 75 degree F. ocean water in Florida for 120 hours. The treated weapon was then removed from immersion and, after drying, was successfully fired. Additionally, there was no observable corrosion effects. The untreated weapon was inoperable and severely corroded.

Fluid friction losses were derived as a function of recorded velocities, barrel lengths, and projectile diameters. The equation employed is as follows for laminar flow (R.5×10) conditions:

H=f lv 2DG

H=Friction loss f=Friction/ballistic coefficient (64/R)

l=length in feet of the barrel v=velocity in feet per second g=acceleration of gravity in feet per second squared d=diameter in feet R=vd/rho

FRICTION LOSSES FOR TREATED AND UNTREATED WEAPONS

| | Untreated | Treated |
|---|---|---|
| Remington 700 | | |
| H | 83.489 | 84.586 |
| H (per foot) | 41.745 | 42.293 |
| Sako Carbine | | |
| H | 49.64 | 50.04 |
| H (per foot) | 24.313 | 24.5 |
| Remington 308 | | |
| H | 40.2215 | 41.076 |
| H (per foot) | 20.99 | 21.44 |
| S & W 38 | | |
| H | 1.312 | 1.323 |
| H (per foot) | 3.94 | 3.97 |

The most underlying and predictive parameter in evaluating dynamic performance are Reynold's numbers. The derived data from a ballistic test are summarized.

REYNOLD'S NUMBERS

| | Untreated | Treated |
|---|---|---|
| Remington 700 | 3.79 × 10 | 3.84 × 10 |
| Ruger 77 | 3.92 × 10 | 4.01 × 10 |
| Remington 308 | 4.37 × 10 | 4.46 × 10 |
| S&W 38 | 1.37 × 10 | 1.39 × 10 |

The immediate and down range effectiveness of a gun system is reflected in its kinetic energy. This factor is expressed by:

$$\text{Kinetic Energy} = \tfrac{1}{2}(w/g)v$$

where:

v = Velocity in feet per second g = Acceleration of gravity in feet per second squared w = Projectile weight in pounds

MUZZLE AND DOWN RANGE KINETIC ENERGY SUMMARY

| | Untreated | Treated |
|---|---|---|
| Remington 700 55 Grain | | |
| Muzzle | 36.84 | 37.82 |
| 100 yds. | 28.9 | 29.7 |
| 200 yds. | 22.4 | 23.02 |
| 300 yds. | 17.13 | 17.75 |
| 400 yds. | 12.96 | 13.45 |
| 500 yds. | 9.75 | 10.05 |
| Remington 308 150 Grain | | |
| Muzzle | 76.7 | 80.0 |
| 100 yds. | 64.3 | 67.13 |
| 200 yds. | 53.6 | 56.06 |
| 300 yds. | 44.5 | 46.6 |
| 400 yds. | 36.7 | 38.5 |
| 500 yds. | 30.15 | 31.65 |
| S & W .357 150 Grain | | |
| Muzzle | 5.29 | 5.39 |
| 100 yds. | 4.36 | 4.44 |
| 200 yds. | 3.59 | 3.66 |
| 300 yds. | 2.95 | 3.02 |
| 400 yds. | 2.44 | 2.48 |
| 500 yds. | 2.005 | 2.05 |

Skin friction/drag for a variety of projectiles fired during the subject tests were calculated. The Blasius laminar flow equation was employed because of the negligible effect of compressibility on the recorded data. The following summarizes friction drag coefficients for some of the weapons tested.

| | Untreated | Treated |
|---|---|---|
| Remington 700 | .0043127 | .0042846 |
| Ruger 77 | .0042427 | .0041938 |
| Remington 308 | .0040173 | .0039753 |

The pressure drag coefficients for two representative weapons are presented.

| | Untreated | Treated |
|---|---|---|
| Remington 700 | .2513 | .2475 |
| Remington 308 | .258 | .252 |

The total drag coefficients as a function of friction and pressure are as follows:

| | Untreated | Treated |
|---|---|---|
| Remington 700 | .2256 | .2518 |
| Remington 308 | .262 | .2555 |

While our invention has been described with particularity as to description, best mode and utility, it should be noted that deviations may occur within the spirit and scope of this invention as set out in the following claims.

What I claim is:

1. A liquid surface penetrating lubricant having improved frictional coefficient reducing properties for surfaces applied thereto comprising:

a) solid lubricant particles selected from a group consisting of fluorinated ethylene propylene (FEP), polytetrafluoroethylene and polytetrafluoroethylene substituted with the radical perfluorinated alkoxy (PFA);

b) a mineral oil coating said particles, whereby coated particles are formed;

c) a lubricant carrier medium having dispersed therein said coated particles;

d) viscosity lowering diluent, wherein said solid lubricant particles are present in the formation in the range of about 0.1 to 15% by volume, and wherein said mineral oil is present in the formulation in the concentration of 5–50% by volume.

2. The formulation of claim 1 wherein said solid lubricant particles is polytetrafluoroethylene.

3. The formulation of claim 2 further comprising the polytetrafluoroethylene particles being prewetted with aliphatic naptha.

4. The formulation of claim 1 wherein said polytetrafluoroethylene particles are sintered.

5. The formulation of claim 1 wherein said mineral oil is 10 weight to 70 weight.

6. The formulation of claim 1 wherein said lubricant carrier medium is a phosphate ester.

7. The formulation of claim 6 wherein said phosphate ester is tricresyl phosphate.

8. The formulation of claim 7 wherein said tricresyl phosphate is present in the formulation in the concentration of 1–3%.

9. The formulation of claim 8 wherein said diluent is an evaporating vehicle.

10. The formulation of claim 9 wherein said vehicle is 1,1,1-trichlorethane.

11. The formulation of claim 10 wherein said trichlorethane is present in the formulation in the concentration of 5–50% by volume.

12. The formulation of claim 1 wherein said viscosity lowering diluent is a flash evaporative vehicle.

13. The formulation of claim 12 wherein said vehicle is 1,1,1 trichloroethane.

14. The formulation of claim 13 wherein said 1,1,1 trichloroethans is present in the formulation in the concentration of 5–50% by volume.

15. A liquid lubricant, comprising:

a) solid lubricant particles, wherein said particles are polytetrafluoroethylene, and wherein said particles are present in the formulation in the concentration of 0.1–15% by volume;

b) a mineral oil coating said particles, whereby coated particles are formed, wherein said mineral oil is 10 weight to 70 weight and wherein said mineral oil is present in the formulation in concentration of 5–50% by volume;

c) a lubricant carrier medium having disbursed therein said particles, wherein said lubricant carrier medium is tricresyl phosphate, and wherein said tricresyl phosphate is present in the formulation in a concentration of 5–50%;

d) a viscosity lowering diluent, wherein said diluent is 1,1,1-trichloroethane, and wherein said trichloroethane is present in the formulation in the concentration of about 40–95% by volume.

16. A liquid lubricant, comprising:

a) solid lubricant particles, wherein said particles are polytetrafluoroethylene, and wherein said particles are present in the formulation in the concentration of 0.1–15% by volume;

b) a mineral oil coating said particles, whereby coated particles are formed, wherein said mineral oil is 10 weight to 70 weight and wherein said mineral oil is present in the formulation in the concentration of 5–50% by volume;

c) a lubricant carrier medium having disbursed therein said particles, wherein said lubricant carrier medium is tricresyl phosphate, and wherein said tricresyl phosphate is present in the formulation in a concentration of 5–50%;

d) 1,1,1 trichloroethano as a flash evaporative vehicle and wherein said 1,1,1 trichloroethane is present in the formulation at 40–95% by volume.

17. The formulation of claim 15 wherein said polytetrafluoroethylene particles are sintered and ground.

18. The formulation of claim 16 wherein said polytetrafluoroethylene particles are sintered and ground.

19. The formulation of claim 14 wherein the 1,1,1-trichloroethane is sold under the trademark CHLOROTHENE VG.

* * * * *